US011607885B2

(12) United States Patent
Mori et al.

(10) Patent No.: US 11,607,885 B2
(45) Date of Patent: Mar. 21, 2023

(54) LIQUID DISCHARGE APPARATUS, CONTROL METHOD THEREOF, AND MEDIUM STORING PROGRAM EXECUTABLE BY LIQUID DISCHARGE APPARATUS

(71) Applicant: Brother Kogyo Kabushiki Kaisha, Nagoya (JP)

(72) Inventors: Masaki Mori, Nagoya (JP); Mikio Hirano, Okazaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 44 days.

(21) Appl. No.: 17/446,071

(22) Filed: Aug. 26, 2021

(65) Prior Publication Data

US 2022/0063283 A1 Mar. 3, 2022

(30) Foreign Application Priority Data

Aug. 28, 2020 (JP) ..... JP2020-144432

(51) Int. Cl.
*B41J 2/17* (2006.01)
*B41J 2/045* (2006.01)
*B41J 2/18* (2006.01)

(52) U.S. Cl.
CPC ..... *B41J 2/1707* (2013.01); *B41J 2/04573* (2013.01); *B41J 2/18* (2013.01)

(58) Field of Classification Search
CPC ..... B41J 2/175; B41J 2/1707; B41J 2/04573; B41J 29/38; B41J 2/17509; B41J 2/14233; B41J 2202/12; B41J 2/18; B41J 2002/14306
See application file for complete search history.

(56) References Cited

U.S. PATENT DOCUMENTS

| | | | | |
|---|---|---|---|---|
| 9,022,536 | B2 | 5/2015 | Ichihara et al. | |
| 9,873,246 | B2 * | 1/2018 | Kato | B41J 2/175 |
| 10,603,921 | B2 * | 3/2020 | Hara | B41J 2/04548 |
| 10,850,529 | B2 * | 12/2020 | Nakano | B41J 2/185 |
| 11,292,267 | B2 * | 4/2022 | Suyama | B41J 2/18 |
| 2014/0168295 | A1 | 6/2014 | Ichihara et al. | |

FOREIGN PATENT DOCUMENTS

| | | |
|---|---|---|
| JP | 2012-140003 A | 7/2012 |
| JP | 2014-117898 A | 6/2014 |

* cited by examiner

*Primary Examiner* — An H Do

(74) *Attorney, Agent, or Firm* — Banner & Witcoff, Ltd.

(57) ABSTRACT

There is provided a liquid discharge apparatus including: a head including a nozzle configured to discharge a liquid, and a driver element configured to apply a pressure to the liquid; a tank configured to store the liquid; a circulation channel configured to circulate the liquid between the head and the tank; a pump; and a controller. The controller is configured to carry out: a non-discharge flushing process of performing a non-discharge flushing by driving the driver element such that the liquid is not discharged from the nozzle; a switching process of switching the pump between ON and OFF; and a determining process of determining a frequency of driving the driver element in the non-discharge flushing process according to a circulation flow amount of the liquid changing due to the switching of the pump between ON and OFF in the switching process.

13 Claims, 8 Drawing Sheets

LIQUID DISCHARGE APPARATUS, CONTROL METHOD THEREOF, AND MEDIUM STORING PROGRAM EXECUTABLE BY LIQUID DISCHARGE APPARATUS

CROSS REFERENCE TO RELATED APPLICATIONS

The present application claims priority from Japanese Patent Application No. 2020-144432, filed on Aug. 28, 2020, the disclosure of which is incorporated herein by reference in its entirety.

BACKGROUND

The present disclosure relates to a liquid discharge apparatus, a control method thereof, and a medium storing a program executable by the liquid discharge apparatus.

There are known liquid jetting apparatuses including a liquid jetting unit to jet a liquid, a liquid container to contain the liquid to be supplied to the liquid jetting unit, a liquid supply channel to circulate the liquid between the liquid jetting unit and the liquid container, and a circulation pump provided for the liquid supply channel.

SUMMARY

According to a first aspect of the present disclosure, there is provided a liquid discharge apparatus including:

a head including a nozzle configured to discharge a liquid, and a driver element configured to apply a pressure to the liquid;

a tank configured to store the liquid;

a circulation channel configured to circulate the liquid between the head and the tank;

a pump; and a controller, wherein the controller is configured to carry out:

a non-discharge flushing process of performing a non-discharge flushing by driving the driver element such that the liquid is not discharged from the nozzle;

a switching process of switching the pump between ON and OFF; and a determining process of determining a frequency of driving the driver element in the non-discharge flushing process according to a circulation flow amount of the liquid changing due to the switching of the pump between ON and OFF in the switching process.

According to a second aspect of the present disclosure, there is provided a control method for a liquid discharge apparatus, wherein the liquid discharge apparatus includes:

a head including a nozzle configured to discharge a liquid, and a driver element configured to apply a pressure to the liquid;

a tank configured to store the liquid;

a circulation channel configured to circulate the liquid between the head and the tank; and a pump, the method including:

performing a non-discharge flushing by driving the driver element such that the liquid is not discharged from the nozzle;

switching the pump between ON and OFF; and determining a frequency of driving the driver element in the non-discharge flushing process according to a circulation flow amount of the liquid changing due to the switching of the pump between ON and OFF.

According to a third aspect of the present disclosure, there is provided a non-transitory computer readable medium storing a program that is executable by a controller of a liquid discharge apparatus, wherein the liquid discharge apparatus includes:

a head including a nozzle configured to discharge a liquid, and a driver element configured to apply a pressure to the liquid;

a tank configured to store the liquid;

a circulation channel configured to circulate the liquid between the head and the tank;

a pump; and the controller, wherein the program causes the controller to carry out:

a non-discharge flushing process of performing a non-discharge flushing by driving the driver element such that the liquid is not discharged from the nozzle;

a switching process of switching the pump between ON and OFF; and a determining process of determining a frequency of driving the driver element in the non-discharge flushing process according to a circulation flow amount of the liquid changing due to the switching of the pump between ON and OFF in the switching process.

DETAILED DESCRIPTION

There are liquid jetting apparatuses which cause a circulation pump to circulate a liquid in a liquid supply channel according to the temperature of the liquid in the liquid supply channel. By virtue of this, reducing the electric power for driving the circulation pump is facilitated. However, stopping the circulation pump may give rise to jetting or discharging defection due to the liquid drying.

The present disclosure is made in view of such problems as the above one, and an object thereof is to provide a liquid discharge apparatus, a control method thereof and a medium storing a program executable by the liquid discharge apparatus which are capable of facilitating reducing the power consumption while lessening the discharging defection due to the liquid drying.

The present disclosure has a configuration explained below; exerting such an effect as to be able to provide a liquid discharge apparatus, a control method thereof and a medium storing a program executable by the liquid discharge apparatus winch are capable of facilitating reducing the power consumption while lessening the discharging defection due to the liquid drying.

Referring to the accompanied drawings, a detailed explanation of an embodiment of the present disclosure will exhibit the abovementioned object, other objects, characteristics, and advantages of the present, disclosure as follows.

Hereinbelow, referring to the accompanied drawings, an explanation will be made on an embodiment of the present disclosure in particular. Note that throughout all drawings in the following explanation, the same reference signs will be assigned to the same or equivalent elements and omission will be made for any repetitive explanation.

An Embodiment

<Configuration of a Liquid Discharge Apparatus>

Figure 1:
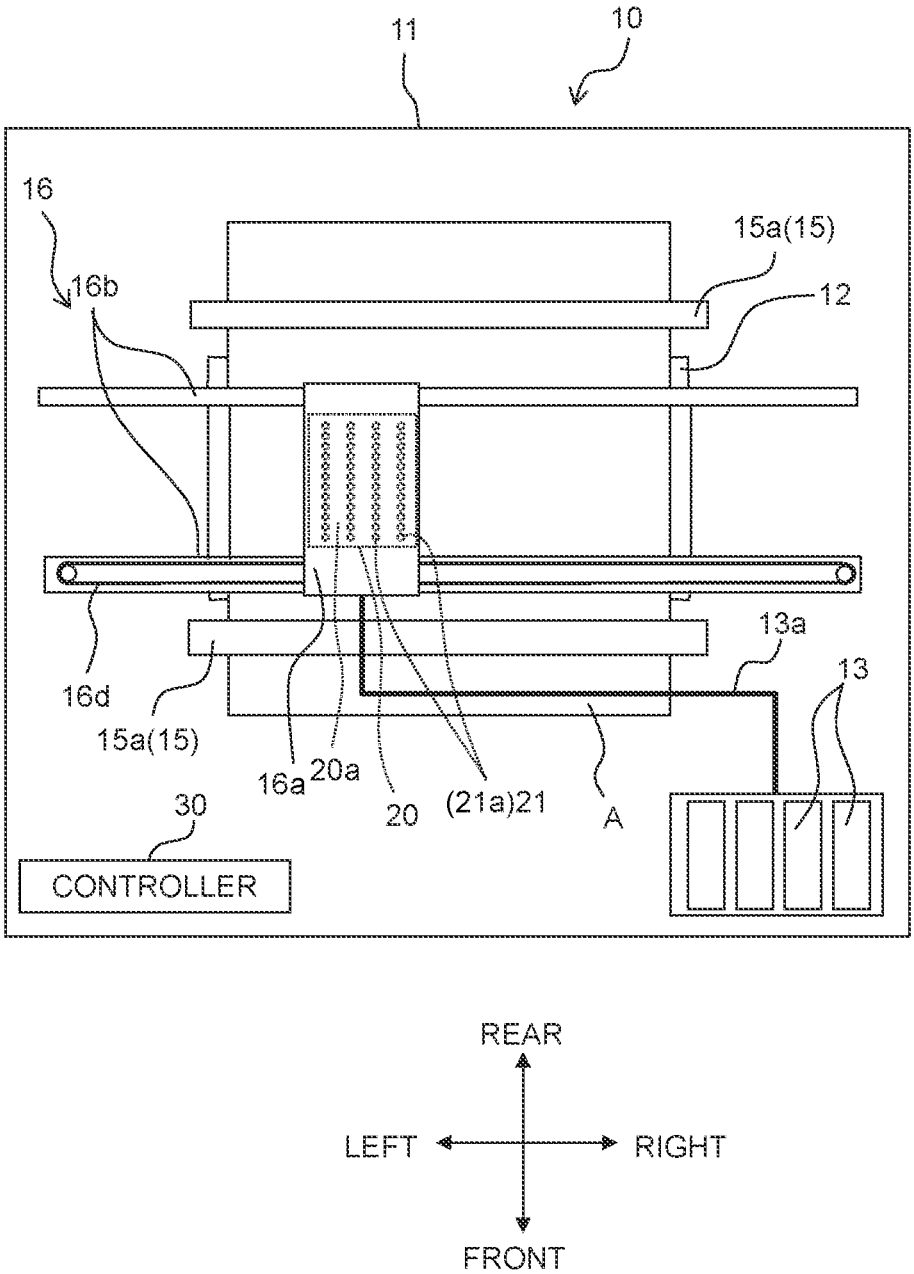
FIG. 1 is a schematic view of a liquid discharge apparatus according to an embodiment of the present disclosure seen from above.

A liquid discharge apparatus 10 according to an embodiment of the present, disclosure is, as depicted in FIG. 1, a device of carrying out printing by discharging a liquid such as ink or the like to a discharging object medium A. For example, the liquid discharge apparatus 10 is an ink jet printer. The liquid discharge apparatus 10 applies a serial head method, and includes a casing 11, a head 20, a platen 12, liquid containers 13, tanks 14 (FIG. 3), a conveyer 15, a scanner 16, and a controller 30. Note that the controller 30 will be described later on in detail. Further, the liquid discharge apparatus 10 may apply a line head method.

In the liquid discharge apparatus 10, the term "up/upper side" is used to refer to the side closer to the head 20 than the platen 12, whereas the term "down/lower side" is used to refer to the opposite side. Further, the term "front side" is used to refer to the downstream side of a direction (conveyance direction) in which the conveyer 15 conveys the discharging object medium A, whereas the term "rear side" is used to refer to the upstream side of the conveyance direction. The term "left/right direction" is used to refer to the direction in which the scanner 16 causes the head 20 to reciprocate. The left/right direction (a scanning direction) intersects the up/down direction and the conveyance direction (orthogonally for example). However, the liquid discharge apparatus 10 is not limited to this arrangement direction.

The casing 11 contains the head 20, the platen 12, the liquid containers 13, the tanks 14, the scanner 16, the conveyer 15, and the controller 30 all in its inner space. The platen 12 has an upper surface for placing or supporting the discharging object medium A. The head 20 has a lower surface (a discharging surface 20*a*) facing the upper surface of the platen 12, and a plurality of nozzles 21 opening in the discharging surface 20*a*. The plurality of nozzles 21 are aligned in the front/rear direction at intervals, for example, to form nozzle arrays. The plurality of nozzle arrays is arranged in the left/right direction at intervals. The head 20 will be described later on in detail.

The liquid containers 13 and the tanks 14 (FIG. 3) are provided to correspond to the nozzle arrays of the head 20. The liquid containers 13 are, for example, ink cartridges removable from the casing 11, connected to the tanks 14 through tubes 13*a*, and arranged above the head 20. The plurality of liquid containers 13 store the liquid of different type from each other (for example, the liquid in the colors of cyan, magenta, yellow, and black), to supply the liquid to the corresponding tanks 14. Note that the tanks 14 will be described later on in detail.

Figure 4:
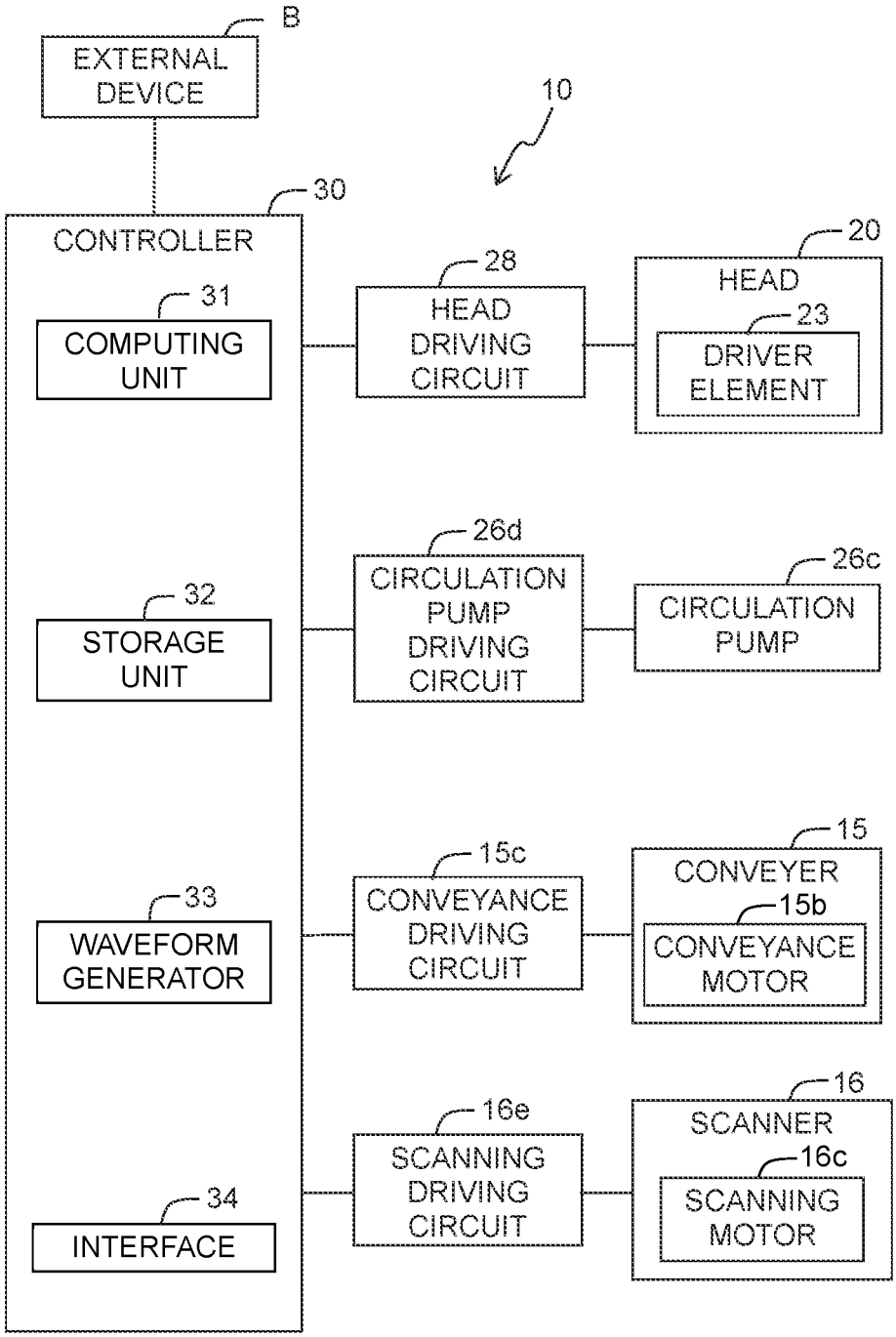
FIG. 4 is a functional block diagram depicting a configuration of the liquid discharge apparatus of FIG. 1.

The conveyer 15 has a pair of conveyance rollers 15*a* and a conveyance motor 15*b* (FIG. 4). The pair of conveyance rollers 15*a* are arranged to interpose the head 20 therebetween in the front/rear direction, their central axes extending in the left/right direction. The conveyance motor 15*b* is linked to the conveyance rollers 15*a* to rotate the conveyance rollers 15*a*. By virtue of this, the conveyer 15 conveys the discharging object medium A on the platen 12 frontward.

The scanner 16 has, for example, a carriage 16*a*, two guide rails 16*b*, a scanning motor 16*c* (FIG. 4), and an endless belt 16*d*. The carriage 16*a* is supported by the guide rails 16*b* to hold the head 20 and allow the head 20 to move reciprocatingly. The endless belt 16*d* extends in the left/right direction along the guide rails 16*b* and is fixed on the carriage 16*a* and linked to the scanning motor 16*c* via a pulley. By rotating the endless belt 16*d* according to the drive of the scanning motor 16*c*, the carriage 16*a* and the head 20 supported by the carriage 16*a* reciprocate in the left/right direction along the guide rails 16*b*.

<Configuration of the Head>

Figure 2:
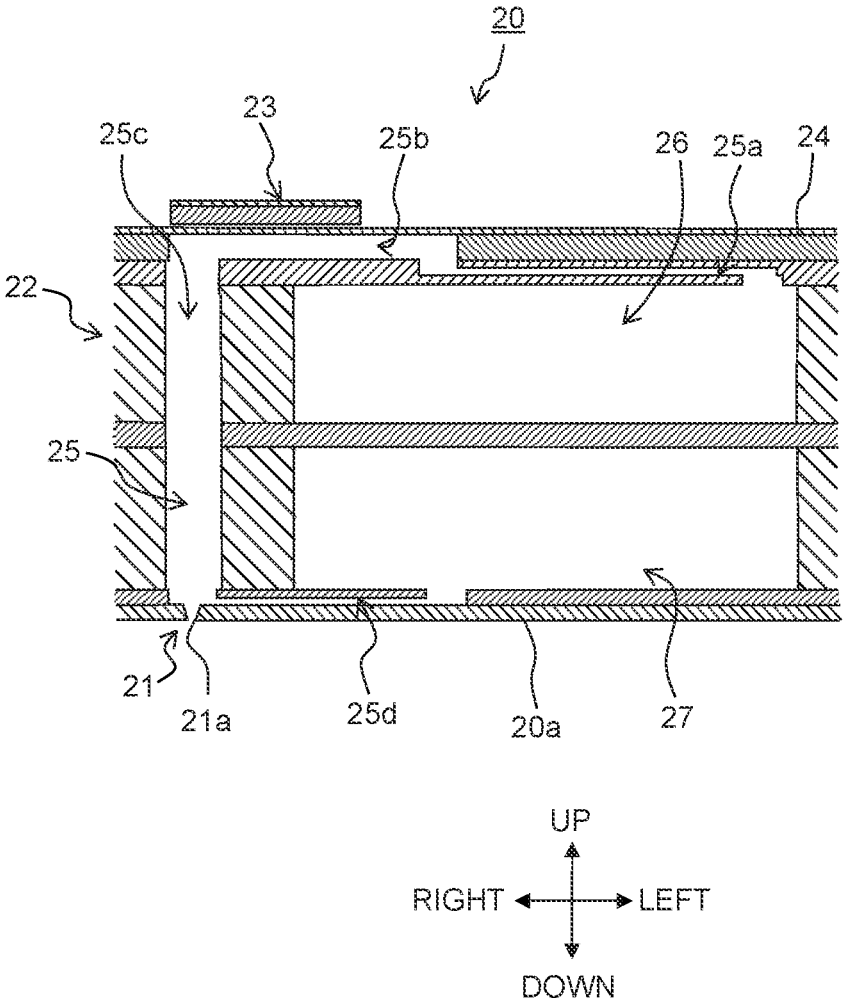
FIG. 2 is a cross section view schematically depicting a head of FIG. 1.

As depicted in FIG. 2, the head 20 has nozzles 21, a channel formation body (flow channel formation body) 22, driver elements 23, and a vibration plate 24. The channel formation body 22 is a layered body of a plurality of plates in each of which holes and ditches in various sizes are formed. In the layered body of each stacked plate, a plurality of liquid channels (liquid flow channels) are formed by combining the holes and ditches.

Figure 3:
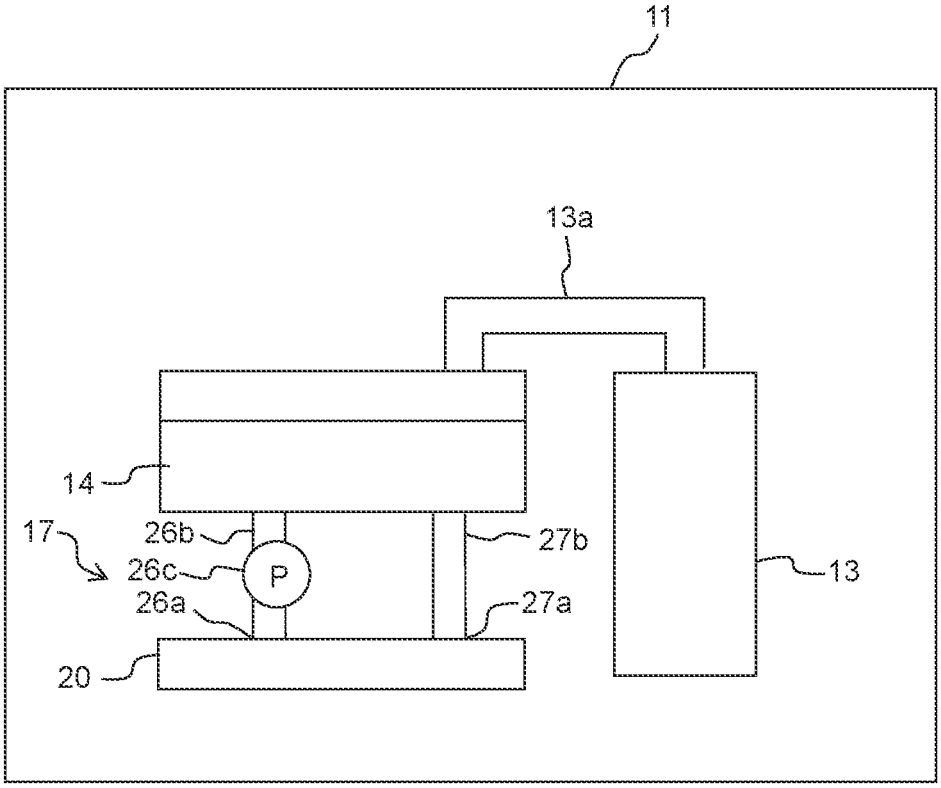
FIG. 3 schematically depicts the head, a liquid container, and a tank of FIG. 1.

The liquid channels have the plurality of nozzles 21, a plurality of individual channels 25, a supply manifold 26, and a return manifold 27. The supply manifold 26 extends in the front/rear direction, having a supply port 26*a* in its end (FIG. 3). The return manifold 27 extends in the front/rear direction, having a return port 27*a* in its end (FIG. 3).

The nozzles 21 have leading ends (nozzle holes 21*a*) opening in the lower surface of the channel formation body 22 (the discharging surface 20*a*). The individual channels 25 reach to the return manifold 27 via the nozzles 21 from the supply manifold 26, having, therebetween, supply throttle channels 25*a*, pressure chambers 25*b*, communication channels 25*c*, and return throttle channels 25*d*. Those channels and chambers are connected in the above order. Here, the nozzles 21 are connected to the communication channels 25*c*, in communication with the pressure chambers 25*b* via the communication channels 25*c*.

The vibration plate 24 is arranged on the channel formation body 22 to cover the upper openings of the pressure chambers 25*b*. The driver elements 23 are, for example, piezoelectric elements arranged on the vibration plate 24 above the pressure chambers 25*b*. The driver elements 23 are connected to the controller 30 (FIG. 1) to expand or contract if a drive signal is applied thereto from the controller 30. According to that, the vibration plate 24 deforms to change the volumes of the pressure chambers 25*b*. By virtue of this, a pressure is applied to the liquid in the pressure chambers 25*b* such that the liquid is discharged from the nozzles 21 or the meniscus in the nozzle holes 21*a* vibrates.

Based on such configuration as above, the liquid flows into the individual channels 25 from the supply manifold 26; and, in the individual channels 25, flows on through the supply throttle flow channels 25*a*, the pressure chambers 25*b* and the communication channels 25*c*; and is supplied to the nozzles 21. Then, by the drive of the driver elements 23, if the pressure is applied to the liquid in the pressure chambers 25*b*, then the liquid is discharged from the nozzles 21. Any liquid having not been discharged from the nozzles 21 and remained in the individual channel, then flows into the return manifold 27 from the return throttle channels 25*d*.

<Tank and Circulation Channel>

As depicted in FIG. 3, the tanks 14 are connected to the liquid containers 13 through the tubes 13*a* and store the liquids supplied from the liquid containers 13 through the tubes 13*a*. Further, each of the tanks 14 is connected to each of the supply ports 26*a* of the supply manifolds 26 (FIG. 2) of the head 20 by a supply tube 26*b*, and connected to each of the return ports 27*a* of the return manifolds 27 (FIG. 2) by a return tube 27*b*.

The supply tube 26*b* is provided with a circulation pump 26*c*. If the circulation pump 26*c* is driven, then the circulation pump 26*c* applies a pressure to the liquid in the supply tube 26*b* such that the liquid stored in the tank 14 may flow to the supply manifold 26. By virtue of this, the liquid is supplied to the supply manifold 26 (FIG. 2) from the tank 14 via the supply tube 26*b* and then supplied to the nozzles 21 (FIG. 2) via the individual channels 25 (FIG. 2).

Then, the liquid having not been discharged from the nozzles 21 and remained in the individual channels flows to the return manifold 27 via the individual channels 25, and return to the tank 14 via the return tube 27*b* from the return port 27*a*. In this manner, the liquid circulates in such an order as from the tank 14 to the supply tube 26*b*, the supply manifold 26, the individual channels 25, the return manifold 27, the return tube 27*b*, and finally returns to the tank 14. Therefore, a circulation channel (a circulation flow channel) 17 is formed from the supply tube 26*b*, the supply manifold 26, the individual channels 25, the return manifold 27, and the return tube 27*b* for the liquid to circulate between the head 20 and the tank 14. A circulation pump 26 is provided for the circulation channel.

<The Controller>

As depicted in FIG. 4, the controller 30 includes a computing unit (calculator) 31, a storage unit (storage) 32, a waveform generator 33, and an interface 34. The interface 34 is connected to an external device B such as a computer, a network or the like, and the controller 30 receives various data such as print data and the like from the external device B via the interface 34. The print data includes image data (raster data for example) expressing images to be printed on the discharging object medium A.

The storage unit 32 is a memory accessible from the computing unit 31 and is constructed of a RAM, a ROM, and the like. The RAM stores various data temporarily. The various data can be exemplified by the print data, and the data converted by the computing unit 31. The ROM stores programs for carrying out various kinds of data processing and other programs. Note that those programs may be obtained from the external device B or stored in another storage medium.

The computing unit 31 is constructed from a processer such as a CPU or the like, and integrated circuits such as an ASIC and the like. With the computing unit 31 executing the programs stored in the ROM, the controller 30 controls the driver elements 23, the circulation pump 26*c*, the conveyance motor 15*b*, and the scanning motor 16*c*, to carry out various processes. For example, the controller 30 carries out a printing process, a non-discharge flushing process, a switching process, and a determining process.

In the non-discharge flushing process, the controller 30 causes the driver elements 23 to drive to such an extent that the liquid may not be discharged from the nozzles 21, so as to move the liquid in the nozzles 21. Further, the controller 30 switches the circulation pump 26*c* between ON (ON-state, that is a state in which the circulation pump 26*c* is driving) and OFF (OFF-state, that is a state in which the circulation pump 26*c* is not driving) in the switching process. Further, in the determining process, the controller 30 determines a frequency of the non-discharge flushing (a frequency of driving the driver element 23 in the non-discharge flushing process) according to the circulation flow amount of the liquid which changes due to the switching of the circulation pump 26*c* between ON and OFF in the switching process. Details of the determining process will be described later.

The waveform generator 33 generates a waveform signal defining the waveform of a drive signal to be outputted to the driver elements 23. The waveform generator 33 may be a dedicated circuit or be constructed from the computing unit 31 and the storage unit 32. The waveform signal includes a discharge waveform signal, a non-discharge waveform signal, and a non-discharge flushing waveform signal.

The discharge waveform signal and the non-discharge flushing waveform signal are pulse signals for causing the driver elements 23 to drive. The discharge waveform signal is a waveform signal for causing the liquid to be discharged from the head 20, and includes a plurality of types of waveform signals different from each other in instruction of the discharging amount. The non-discharge flushing waveform signal is a waveform signal for the non-discharge flushing which vibrates the meniscus in the nozzle hole 21*a* such that the liquid is not discharged from the head 20. The non-discharge waveform signal is a waveform signal for causing no drive of the driver element 23. Therefore, the non-discharge flushing waveform signal and the non-discharge waveform signal are signals where the liquid discharging amount is zero.

The computing unit 31 generates a waveform selection data, for example, by selecting one type of waveform signal from the plurality of types of waveform signals for each nozzle 21 and each drive period according to the liquid discharging amount of each droplet on the basis of the print data. In this context, the computing unit 31 generates the waveform selection data such that the discharge waveform signal indicating larger liquid discharge amount is selected for the denser part of the image to be printed, based on the print data. Further, the computing unit 31 generates the waveform selection data such that the non-discharge waveform signal is selected based on the print data or the non-discharge flushing waveform signal is selected according to the frequency determined in the determining process, for the range (area) of not printing image.

The controller 30 is connected to the driver elements 23 via a head driving circuit 28. The controller 30 outputs the waveform signal and the waveform selection data as a control data to the head driving circuit 28. Based on the received waveform signal and the waveform selection data, the head driving circuit 28 generates the drive signal and outputs the same to the driver elements 23. The driver elements 23 are driven according to the drive signal in the output order of the waveform signals. By virtue of this, the volumes of the pressure chambers 25*b* are changed to apply the pressure to the liquid in the pressure chambers 25*b* such that the liquid is discharged from the nozzles 21 or the meniscus in the nozzle holes 21*a* vibrates.

Further, the controller 30 is connected to the conveyance motor 15*b* via a conveyance driving circuit 15*c*, to output the control data for the conveyance motor 15*b* on the basis of the print data to the conveyance driving circuit 15*c*. Further, the controller 30 is connected to the scanning motor 16*c* via a scanning driving circuit 16*e*, to output the control data for the scanning motor 16*c* on the basis of the print data to the scanning driving circuit 16*e*. By virtue of this, the controller 30 controls the drive timing, rotation speed, rotation amount and the like for the conveyance motor 15*b* and the scanning motor 16*c*.

In this manner, the controller 30 carries out a recording operation and a conveying operation by controlling those respective units. In the recording operation, the controller 30 records the images on the discharging object medium A with the scanning motor 16*c* moving the head 20 and with the driver elements 23 causing the liquid to be discharged from the head 20. Further, in the conveying operation, the controller 30 causes the conveyance motor 15*b* to convey the discharging object medium A. By repeating the recording operation and the conveying operation alternately, the images are gradually formed on the discharging object medium A in the conveyance direction by the liquid discharged from the nozzles 21 such that the printing process proceeds accordingly.

Further, the controller 30 is connected to the circulation pump 26*c* via a circulation pump driving circuit 26*d* to output the control data for the circulation pump 26*c* to the circulation pump driving circuit 26*d*. By virtue of this, the controller 30 controls the drive timing to turn on or off the circulation pump 26*c* so as to circulate a predetermined flow amount of the liquid in the circulation channel 17.

<The Determining Process>

Figure 5A:
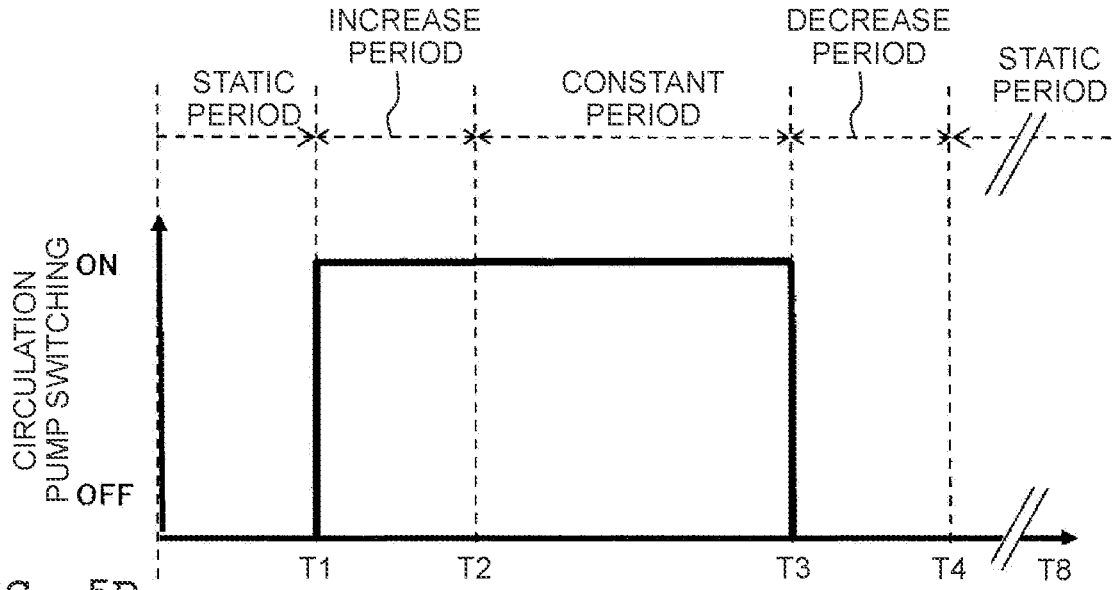
FIG. 5A is a graph depicting a switching timing for a circulation pump of FIG. 1.

For example, the controller 30 acquires the switching timings to turn on and off the circulation pump 26*c* on the basis of the print data, in the example of FIG. 5A, the circulation pump 26*c* is switched from OFF to ON at a first time T1, and switched from ON to OFF at a third time T3. By virtue of this, the circulation pump 26*c* comes to the QN-state for driving from the OFF-state for not driving at the first time T1, and is maintained at the ON-state from the first time T1 to the third time T3, whereas at the third time T3, it comes to the OFF-state from the ON-state and is maintained at the OFF-state after the third time T3.

Figure 5B:
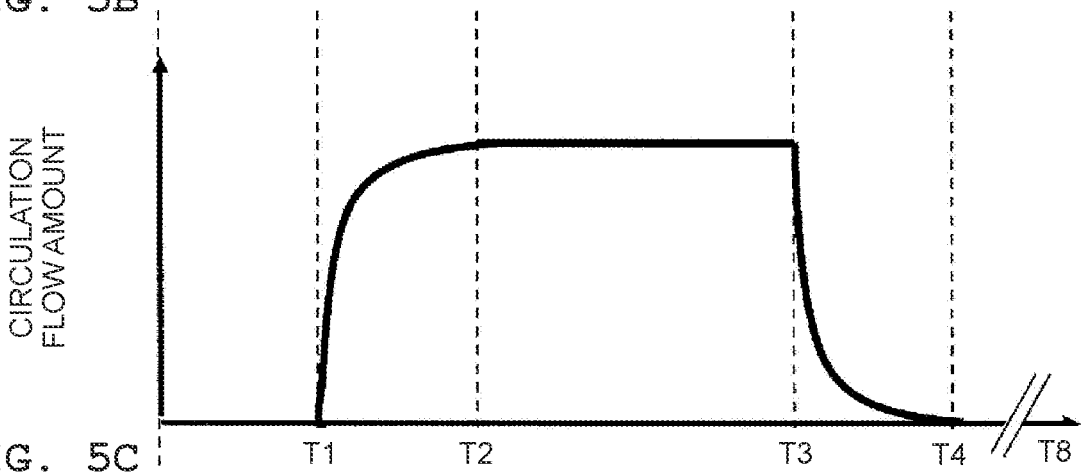
FIG. 5B is a graph depicting a temporal change of a circulation flow amount of a liquid in a circulation channel over a period depicted in FIG. 5A.

On this occasion, as depicted in FIG. 5B, in the static period before starting to drive the circulation pump 26*c*, the liquid does not flow in the circulation channel 17 such that the circulation flow amount is zero. Then, by starting to drive the circulation pump 26*c* at the first time T1, the liquid begins to flow in the circulation channel 17 such that the liquid increases in the circulation flow amount in the circulation channel 17. Then, in the increase period from the first time T1 to the second time T2, the circulation flow amount increases, and in the constant period from the second time T2 to the third time T3, the circulation flow amount stays constant.

Because driving the circulation pump 26*c* is ended at the third time T3, the liquid begins to decrease in the circulation flow amount in the circulation channel 17. In the decrease period from the third time T3 to a fourth time T4, the circulation flow amount keeps decreasing. Then, in the static period after the fourth time T4, the circulation flow amount stops decreasing and the circulation flow amount of the liquid is zero. The relation between the switching of the circulation pump 26*c* and the circulation flow amount of the liquid such as above is found through experiment, simulation and the like in advance, and then stored in the storage unit 32.

In this manner, with the liquid circulating in the circulation channel 17 with the circulation pump 26*c* in the ON-state, it is possible to reduce the thickening of the liquid due to the drying in the nozzles 21 in communication with the circulation channel 17. On the other hand, with the circulation pump 26*c* in the OFF-state, because the liquid does not circulate, the liquid is more likely to thicken due to the drying in the nozzles 21. Therefore, in the determining process, the controller 30 determines the frequency of the non-discharge flushing for a period in which the circulation pump 26*c* is in the OFF-state to be the same as or higher than the frequency of the non-discharge flushing for a period in which the circulation pump 26*c* is in the ON-state.

Figure 5C:
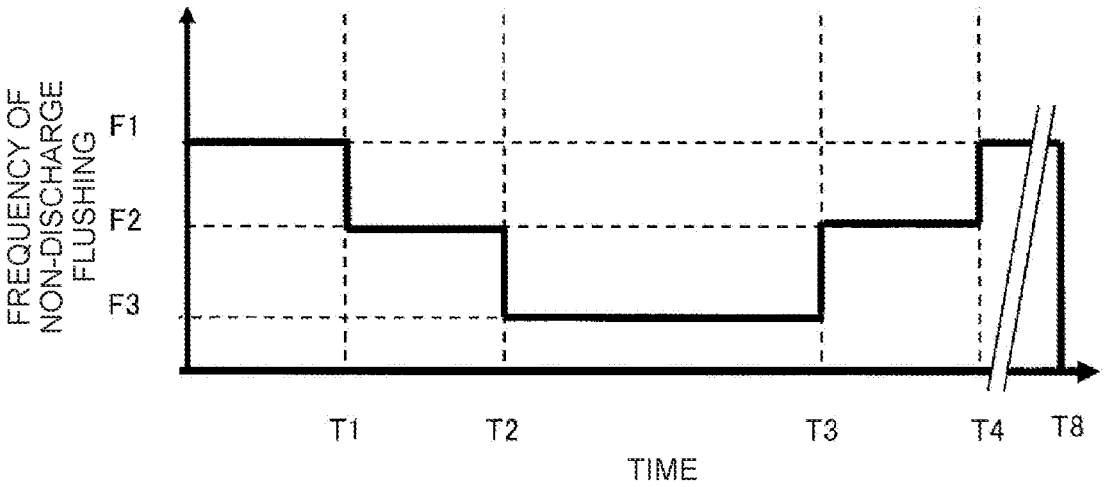
FIG. 5C is a graph depicting a frequency of non-discharge flushing of driver elements over the period depicted in FIG. 5A.

For example, as depicted in FIG. 5C, regarding the OFF-state period before the first time T1, the controller 30 determines the frequency of the non-discharge flushing to be a first predetermined frequency F1 and causes the storage unit 32 to store the same. Further, regarding the OFF-state period after the third time T3, the controller 30 determines the frequency for the decrease period to be a second predetermined frequency F2 and determines the frequency for the static period after the decrease period to be the first predetermined frequency F1, and then causes the storage unit 32 to store the both. Further, regarding the ON-state period, the controller 30 determines the frequency for the increase period to be the second predetermined frequency F2 and determines the frequency for the constant period to be a third predetermined frequency F3, and then causes the storage unit 32 to store the both. The first predetermined frequency F1 is higher than the second predetermined frequency F2, and the second predetermined frequency F2 is higher than the third predetermined frequency F3.

In this manner, by turning off the circulation pump 26*c*, it is possible to facilitate reducing the electric power for driving the circulation pump 26*c*. Further, by letting the frequency of the non-discharge flushing for the OFF-state be the same as or higher than the frequency of the non-discharge flushing for the ON-state, it is possible to reduce the discharging defection due to the liquid drying in the nozzles 21. Further, by reducing the frequency of the non-discharge flushing for the ON-state of the circulation pump 26*c* to be lower than the frequency of the non-discharge flushing for the OFF-state of the circulation pump 26*c*, it is possible to restrain the driver elements 23 from degradation due to the driving.

<Method for Controlling the Liquid Discharge Apparatus>

Figure 6:
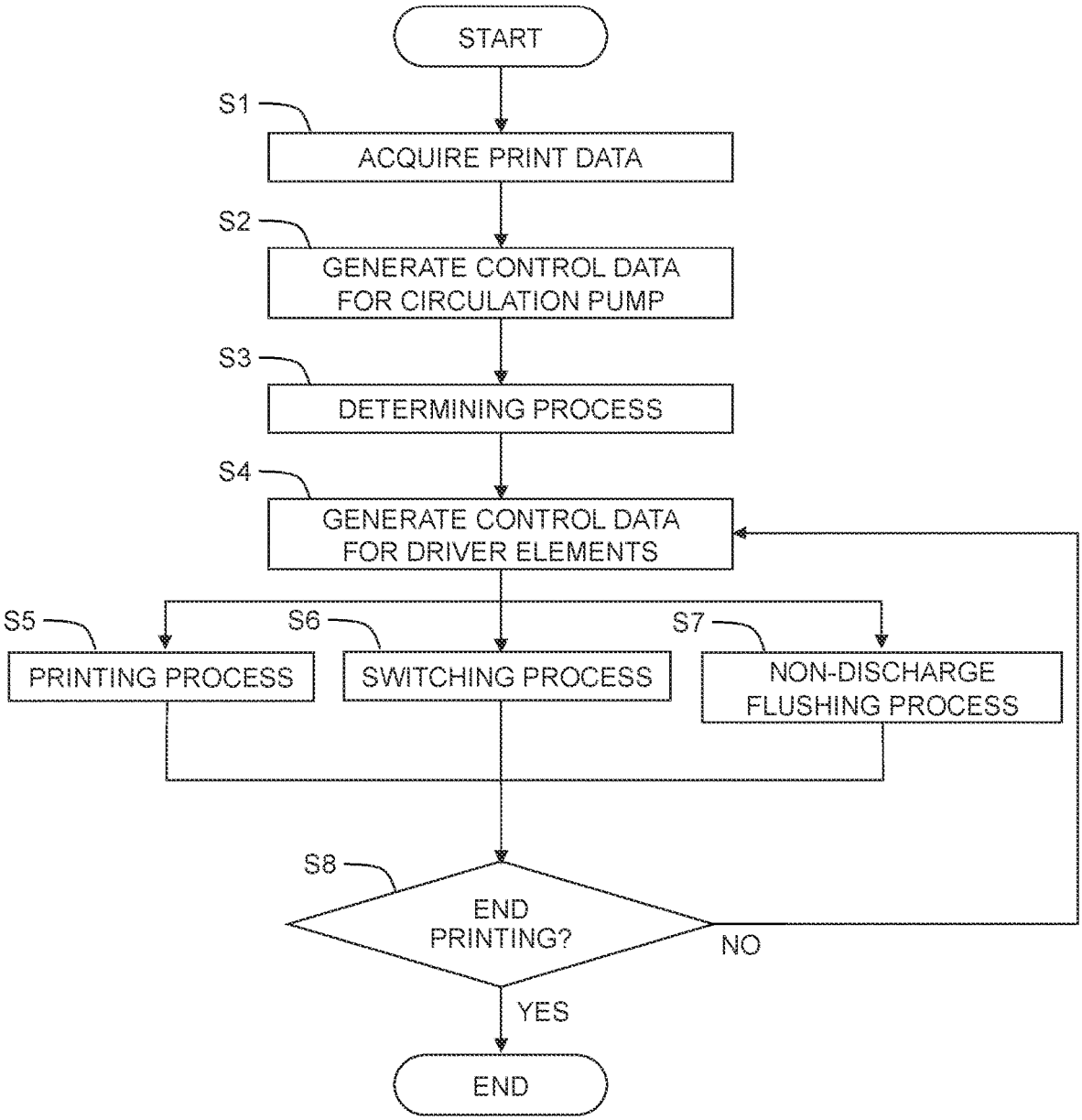
FIG. 6 is a flow chart depicting an example of control method of the liquid discharge apparatus of FIG. 1.

The control method for the liquid discharge apparatus 10 is, for example, carried out by the controller 30 following the flow chart of FIG. 6. First, the controller 30 acquires a print data (step S1). The controller 30 determines the switching timing between turning on and off the circulation pump 26*c* on the basis of the print data, and generates a control data for the circulation pump 26*c* (step S2). The print data is associated beforehand with the switching timing for the circulation pump 26*c*, and stored in the storage unit 32.

The controller 30 carries out the determining process on the basis of the switching timing for the circulation pump 26*c* (step S3). In the determining process, the controller 30 determines the frequency of the non-discharge flushing according to the circulation flow amount of the liquid changed by switching the circulation pump 26*c* between ON and OFF in the switching process.

Then, the controller 30 generates the control data for the driver elements 23 according to the print data, and the frequency of the non-discharge flushing determined in the determining process (step S4). Here, the controller 30 generates the waveform selection data according to the print image based on the print data. The waveform selection data is print processing data in which data indicating selection of the discharge waveform signal and data indicating selection of the non-discharge waveform signal are arranged for each drive element 23 in the output order (sequence). Further, the controller 30 generates the control data for the driver elements 23 by replacing the data indicating selection of the non-discharge waveform signal in the print processing data with the data indicating selection of the non-discharge flushing waveform signal to satisfy the determined frequency.

Then, on the basis of those control data, the controller 30 conducts parallel performances of a printing process (step S5), a switching process (step S6), and a non-discharge flushing process (step S7) until the printing based on the print data is finished (step S8: YES). Note that until the printing is finished, the switching process in which the circulation pump 26*c* is turned on and then turned off may be carried out once or multiple times.

In tins context, the controller 30 outputs the control data for the driver elements 23 to the head driving circuit 28. The head driving circuit 28 generates the drive signal according to the waveform signal selected or indicated by the waveform selection data and outputs the generated drive signal to the driver elements 23. By virtue of this, in the printing process, the driver elements 23 drive according to the drive signal for the discharge waveform signal such that the liquid is discharged from the nozzles 21 and the image is printed on the discharging object medium A on the basis of the print data. Further, in the non-discharge flushing process, the driver elements 23 drive according to the drive signal for the non-discharge flushing waveform signal such that the meniscuses of the nozzle holes 21*a* vibrate and the non-discharge flushing is carried out at the frequency determined by the determining process. By the non-discharge flushing, the liquid spreads in the nozzles 21, and thereby it is possible to reduce the discharging defection due to the liquid drying.

Further, the controller 30 outputs the control data for the circulation pump 26*c* to the circulation pump driving circuit 26*d*. By virtue of this, in the switching process, as in the example of FIG. 5A, the circulation pump 26*c* is switched from OFF to ON at the first time T1. By virtue of this, the liquid in the circulation channel 17 circulates, and thereby it is possible to reduce the discharging defection due to the liquid drying.

Further, the circulation pump 26*c* is switched from ON to OFF at the third time T3. On this occasion, by carrying out the non-discharge flushing in a period in which the circulation pump 26*c* is in the OFF-state at the frequency equal to or higher than the frequency in a period in which the circulation pump 26*c* is in the ON-state, it is possible to reduce the power consumption for the circulation pump 26*c* while reducing the discharging defection due to the liquid drying. Further, by carrying out the non-discharge flushing in a period in which the circulation pump 26*c* is in the ON-state at the frequency equal to or lower than the frequency in a period in which the circulation pump 26*c* is in the OFF-state, it is possible to facilitate reducing the degradation of the driver elements 23 while reducing the discharging defection due to the liquid drying.

First Modified Embodiment

A first modified embodiment may be a modification of the above embodiment. In the liquid discharge apparatus 10 according to the first modified embodiment, the circulation flow amount of the liquid increases in an increase period due to the switching of the circulation pump 26*c* from OFF to ON, stays constant in a constant period following the increase period, and decreases in a decrease period following the constant period due to the switching of the circulation pump 26*c* from ON to OFF. In the determining process, the controller 30 determines the frequency of the non-discharge flushing such that the frequency of the non-discharge flushing for the increase period from the first time T1 to the second time T2 and the frequency of the non-discharge flushing for the decrease period from the third time T3 to the fourth time T4 are larger than the frequency of the non-discharge flushing for the constant period from the time T2 to the time T3.

The increase period and the decrease period are acquired in advance through experiment or simulation, and then stored in the storage unit 32. For example, in the determining process of the step S3 of FIG. 6, the controller 30 acquires the timing for turning on the circulation pump 26*c* (to be refereed to below as the "on timing" as appropriate) and the timing for turning off the circulation pump 26*c* (to be refereed to below as the "off timing" as appropriate) in the printing process on the basis of the print data, and acquires the increase period and the decrease period from the storage unit 32.

As depicted in FIGS. 5A and 5B, the controller 30 uses the on timing (the first time T1) as an increase start time of the flow amount, and calculates the increase end time of the flow amount (the second tune T2) by adding the increase period to the increase start time of the flow amount. Further, the controller 30 uses the off timing (the third time T3) as a decrease start time of the flow amount, and calculates the period between the increase end time and the decrease start time as a constant period during which the flow amount is constant. Further, the controller 30 calculates the decrease end time of the flow amount (the fourth time T4) by adding the decrease period to the decrease start time.

Further, as depicted in FIG. 5C, the controller 30 determines the third predetermined frequency F3 as the frequency of the non-discharge flushing in the constant period, and causes the storage unit 32 to store the same. Further, the controller 30 determines the second predetermined frequency F2 higher than the third predetermined frequency F3 as the frequency for the increase period and the decrease period, and causes the storage unit 32 to store the same. Further, the controller 30 determines the first predetermined frequency F1 as the frequency for the static period before the increase period and the static period after the decrease period, and causes the storage unit 32 to store the same.

By virtue of this, in the increase period and in the decrease period, although the circulation flow amount of the liquid is smaller than that in the constant period, because the frequency in the non-discharge flushing is higher than that in the constant period, it is possible to reduce the discharging defection due to the liquid drying. Further, by letting the frequency of the non-discharge flushing in the constant period be lower than that in the increase period and in the decrease period, it is possible to restrain the driver elements 23 from degrading due to the driving of the driver elements 23.

Second Modified Embodiments

A second modified embodiment may be a modification of the above embodiment and the first modified embodiment. In the liquid discharge apparatus 10 according to the second modified embodiment, the controller 30 carries out at least one of a first non-discharge flushing process and a second non-discharge flushing process (that is, the first non-discharge flushing process and/or the second non-discharge flushing process). In the first non-discharge flushing process, the controller 30 carries out the non-discharge flushing at the frequency determined in the determining process in a period closer to the time when the increase of the circulation flow amount of the liquid ends than to the time when the increase of the circulation flow amount of the liquid begins (that is, the later half of the increase period), during the increase period. In the second non-discharge flushing process, the controller 30 carries out the non-discharge flushing at the frequency determined in the determining process in a period closer to the time when the decrease of the circulation flow amount of the liquid ends than to the time when the decrease of the circulation flow amount of the liquid begins (that is, the later half of the decrease period), during the decrease period.

Figure 7A:
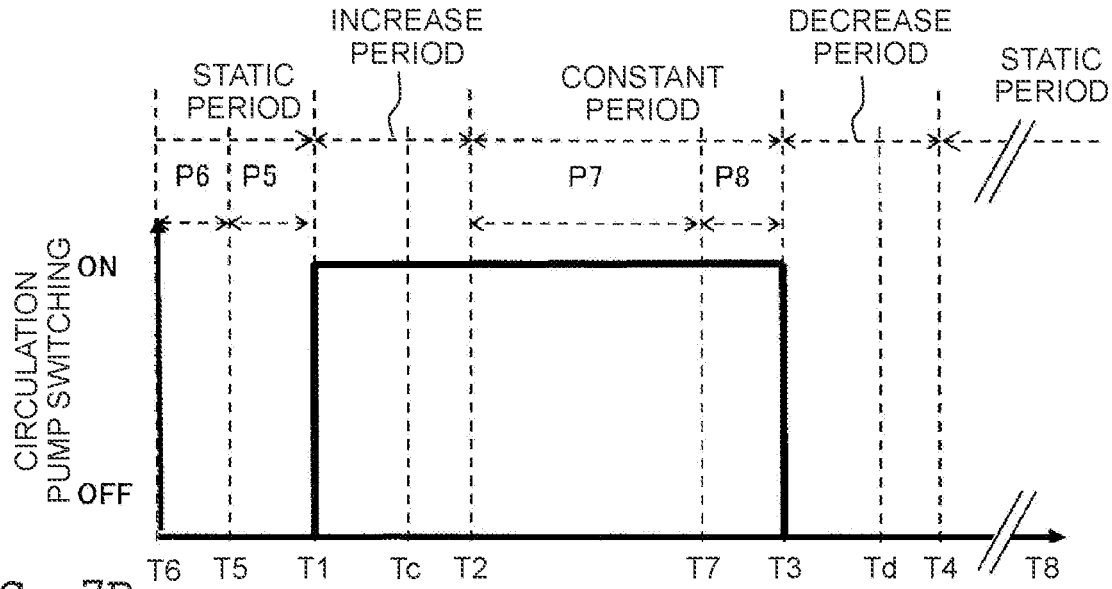
FIG. 7A is a graph depicting a switching timing for a circulation pump of a liquid discharge apparatus according to a second modified embodiment.
Figure 7B:
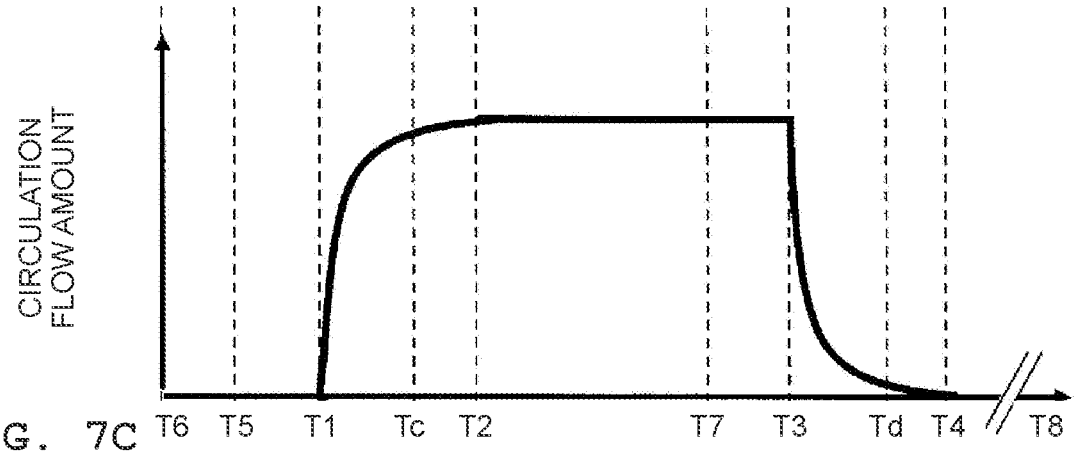
FIG. 7B is a graph depicting a temporal change of a circulation flow amount of the liquid in a circulation channel over a period depicted in FIG. 7A.

For example, by turning on the circulation pump 26*c* as depicted in FIG. 7A, the circulation flow amount of the liquid increases in the increase period from the first time T1 to the second time T2, as depicted in FIG. 7B. The increase rate of this circulation flow amount decreases gradually from the increase start time (the first time T1) on approaching the increase end time (the second time T2). Along with that, the meniscuses in the nozzle holes 21*a* are gradually stabilized from the first time T1 on approaching the second time T2.

Further, by turning off the circulation pump 26*c*, the circulation flow amount of the liquid decreases in the decrease period from the third time T3 to the fourth time T4. The decrease rate of this circulation flow amount decreases gradually from the decrease start time (the third time T3) on approaching the decrease end time (the fourth time T4). Along with that, the meniscuses in the nozzle holes 21*a* are gradually stabilized from the third time T3 on approaching the fourth time T4.

Figure 7C:
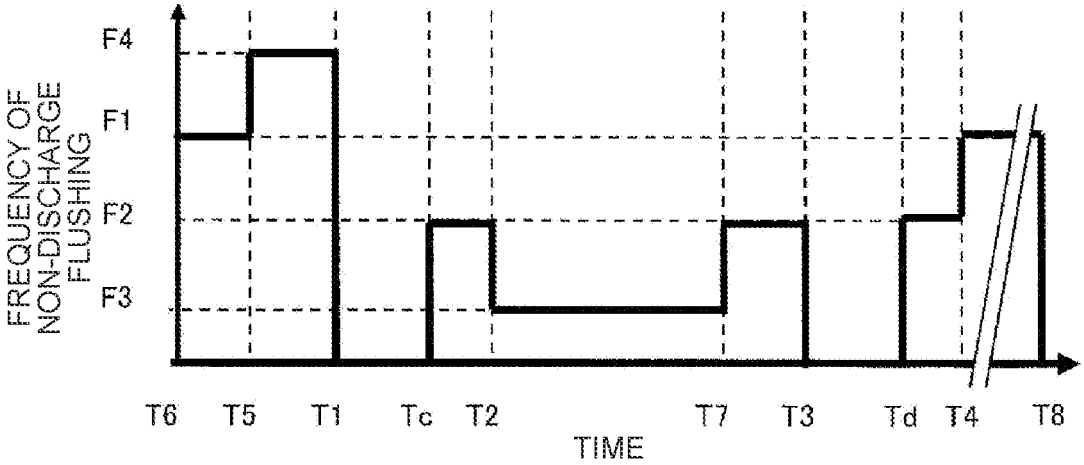
FIG. 7C is a graph depicting a frequency of the non-discharge flushing of the driver elements over the period depicted in FIG. 7A.

Therefore, in the step S4 of FIG. 6, the controller 30 generates the control data for the driver elements 23 such that the non-discharge flushing may be carried out in the period of the stabilized meniscus. On this occasion, as depicted in FIG. 7C, for example, the controller 30 acquires a time Tc, in the increasing period, having the period to the second time T2 shorter than the period from the first time T1 (that is, a time later than the midpoint between the first time T1 and the second time T2). During the period from the time Tc to the second time T2, the controller 30 replaces the data indicating selection of the non-discharge waveform signal with the data indicating selection of the non-discharge flushing waveform signal to satisfy the determined frequency of the non-discharge flushing. The controller 30 does not make such replacement in the period from the first time T1 to the time Tc.

Further, the controller 30 acquires a time Td, in the decrease period, having the period to the fourth time T4 shorter than the period from the third time T3 (that is, a time later than the midpoint between the third time T3 and the fourth time T4). During the period from the time Td to the fourth time T4, the controller 30 replaces the data indicating selection of the non-discharge waveform signal with the data indicating selection of the non-discharge flushing waveform signal to satisfy the determined frequency of the non-discharge flushing. The controller 30 does not make such replacement in the period from the third time T3 to the time Td.

If the driver elements 23 drive on the basis of the control data, then the controller 30 carries out at least one of the first non-discharge flushing process and the second non-discharge flushing process (that is, the first non-discharge flushing process and/or the second non-discharge flushing process) in the non-discharge flushing process of the step S7. If the first non-discharge flushing process is carried out, then the non-discharge flushing is not carried out in the period from the first time T1 to the time Tc during the increase period, but is carried out at the frequency determined in the determining process in the period from the time Tc to the second time T2.

Further, if the second non-discharge flushing process is carried out, then the non-discharge flushing is not carried out in the period from the third time T3 to the time Td during the decrease period, but is carried out at the frequency determined in the determining process in the period from the time Td to the fourth time T4. By carrying out the non-discharge flushing in such a period that the meniscus is stable, it is possible to reduce the discharging defection due to the liquid drying while preventing meniscus break and unintended discharges.

Third Modified Embodiment

A third modified embodiment may be a modification of the above embodiment and the first modified embodiment. In the liquid discharge apparatus 10 according to the third modified embodiment, the controller 30 carries out at least one of a third non-discharge flushing process and a fourth non-discharge flushing process (that is, the third non-discharge flushing process and/or the fourth non-discharge flushing process).

Figure 8A:
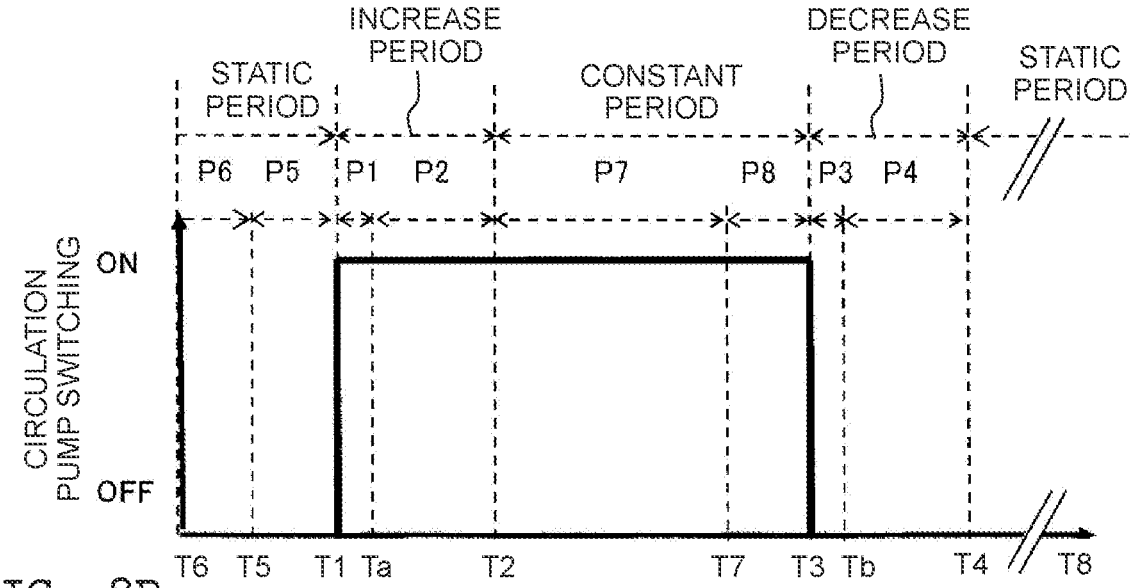
FIG. 8A is a graph depicting a switching timing for a circulation pump of a liquid discharge apparatus according to third and fourth modified embodiments.
Figure 8B:
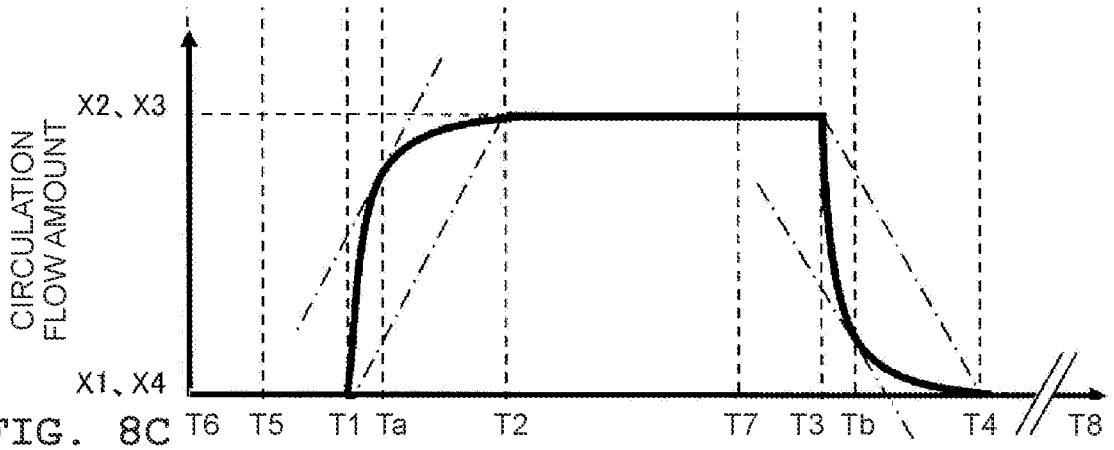
FIG. 8B is a graph depicting a temporal change of a circulation flow amount of the liquid in a circulation channel over a period depicted in FIG. 8A.
Figure 8C:
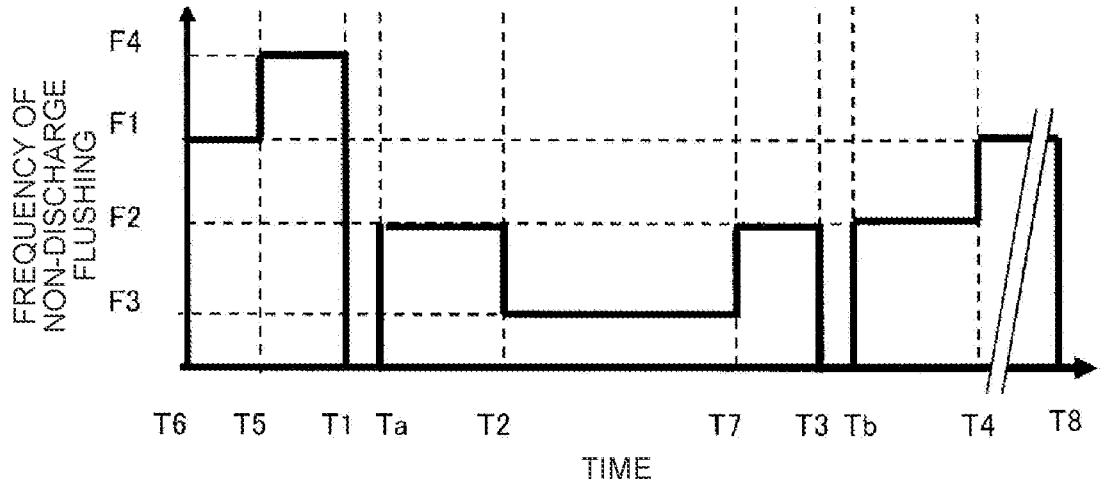
FIG. 8C is a graph depicting a frequency of the non-discharge flushing of the driver elements over the period depicted in FIG. 8A.

In the third non-discharge flushing process, as depicted in FIG. 8C, a first time (the start time) T1 is the start time of the increase period and a second time (the end time) T2 is the end time, and a circulation flow amount X1 is the circulation flow amount of the liquid at the first time T1, and a circulation flow amount X2 is the circulation flow amount of the liquid at the second time T2. On this occasion, the controller 30 starts the non-discharge flushing at the frequency determined in the determining process either at the time Ta when the increase rate of the circulation flow amount of the liquid satisfies (X2−X1)/(T2−T1), or in the period between the time Ta and the second time T2.

In the fourth non-discharge flushing process, third time (the start time) T3 is the start tune of the decrease period and a fourth tune (the end time) T4 is the end time, and a circulation flow amount X3 is the circulation flow amount of the liquid at the third time T3, and a circulation flow amount X4 is the circulation flow amount of the liquid at the fourth time T4. On this occasion, the controller 30 starts the non-discharge flushing at the frequency determined in the determining process either at the time Tb when the decrease rate of the circulation flow amount of the liquid satisfies (X3−X4)/(T4−T3), or in the period between the time Tb and the fourth time T4.

For example, by turning on the circulation pump 26*c* as depicted in FIG. 8A, the circulation flow amount of the liquid increases logarithmically in the increase period, as depicted in FIG. 8B. Let an increase rate Ra of the circulation flow amount at the time Ta be (X2−X1)/(T2−T1). In this case, the increase rate in the first period P1 from the first time T1 to the time Ta is higher than the increase rate Ra. The increase rate in the second period P2 from the time Ta to the second time T2 is lower than the increase rate Ra. The meniscus is more stable in the second period P2 than in the first period P1.

Further, by turning off the circulation pump 26*c*, the circulation flow amount of the liquid decreases logarithmically in the decrease period. Let a decrease rate Rb of the circulation flow amount at the time Tb be (X3−X4)/(T4−T3). In this case, the decrease rate in the third period P3 from the third time T3 to the time Tb is higher than the decrease rate Rb. The decrease rate in the fourth period P4 from the time Tb to the fourth time T4 is lower than the decrease rate Rb. The meniscus is more stable in the fourth period P4 than in the third period P3.

In the step S4 of FIG. 6, the controller 30 generates the control data for the driver elements 23 such that the non-discharge flushing is carried out in the period of stable meniscus. On this occasion, for example, regarding the increase period, the controller 30 acquires from the storage unit 32 the circulation flow amount X1 at the first time T1, the circulation flow amount X2 at the second time T2, and the increase period (T2−T1). Note that the relation between the switching of the circulation pump 26*c* and the circulation flow amount is associated in advance and stored in the storage unit 32. Further, the increase period and the decrease period are stored in the storage unit 32 in advance.

From those data, the controller 30 calculates the increase rate Ra of the circulation flow amount, and the time Ta when the increase rate of the circulation flow amount in the circulation channel 17 reaches the increase rate Ra. Regarding the second period P2, the controller 30 replaces the date indicating selection of the non-discharge waveform signal with the data indicating selection of the non-discharge flushing waveform signal to satisfy the determined frequency of the non-discharge flushing.

Further, regarding the decrease period, the controller 30 acquires from the storage unit 32 the circulation flow amount X3 at the third time T3, the circulation flow amount X4 at the fourth time T4, and the decrease period (T4−T3). From those data, the controller 30 calculates the decrease rate Rb of the circulation flow amount, and the time Tb when the decrease rate of the circulation flow amount in the circulation channel 17 reaches the decrease rate Rb. Regarding the fourth period P4, the controller 30 replaces the data indicating selection of the non-discharge waveform signal with the data indicating selection of the non-discharge flushing waveform signal to satisfy the determined frequency of the non-discharge flushing.

If the driver elements 23 drive on the basis of the control data, then the controller 30 carries out at least one of the third non-discharge flushing process and the fourth non-discharge flushing process (that is, the third non-discharge flushing process and/or the fourth non-discharge flushing process) in the non-discharge flushing process of the step S7, If the third non-discharge flushing process is carried out, then the non-discharge flushing is carried out in the second period P2 at the frequency determined in the determining process. Further, if the fourth non-discharge flushing process is carried out, then the non-discharge flushing is carried out in the fourth period P4 at the frequency determined in the determining process. By carrying out the non-discharge flushing in such a period that the meniscus is stable, it is possible to reduce the discharging defection due to the liquid drying while preventing meniscus break and unintended discharges.

Fourth Modified Embodiment

A fourth modified embodiment may be a modification of the third modified embodiment. In the liquid discharge apparatus 10 according to the fourth modified embodiment, the increase period includes the first period P1 from the first time (the start time) T1 to the time Ta, and the second period P2 from the time Ta to the second time (the end time) T2. The decrease period includes the third period P3 from the third time (the start time) T3 to the time Tb, and the fourth period P4 from the time Tb to the fourth time (the end time) T4. The controller 30 carries out at least one of the non-discharge flushing process performing the non-discharge flushing in the second period P2 without performing the non-discharge flushing in the first period P1, the non-discharge flushing process performing the non-discharge flushing in the fourth period P4 without performing the non-discharge flushing in the third period P3, the non-discharge flushing process performing the non-discharge flushing in the second period P2 and the fourth period P4 without performing the non-discharge flushing in the first period P1 and the third period P3.

On this occasion, in the step S4 of FIG. 6, regarding the second period P2, the controller 30 replaces the date indicating selection of the non-discharge waveform signal with the data indicating selection of the non-discharge flushing waveform signal to satisfy the determined frequency of the non-discharge flushing. The controller 30 does not make such replacement regarding the first period P1. Further, regarding the fourth period P4, the controller 30 replaces the data indicating selection of the non-discharge waveform signal with the data indicating selection of the non-discharge flushing waveform signal to satisfy the determined frequency of the non-discharge flushing. The controller 30 does not make such replacement regarding the third period P3.

If the driver elements 23 drive on the basis of the control data, then in the non-discharge flushing process of the step S7 of FIG. 6, if the third non-discharge flushing process as depicted in FIG. 8C is carried out, then the non-discharge flushing is carried out in the second period P2 at the frequency determined in the determining process, but is not carried out in the first period P1. Further, if the fourth non-discharge flushing process is carried out, then the non-discharge flushing is carried out in the fourth period P4 at the frequency determined in the determining process, but is not carried out in the third period P3. Without carrying out the non-discharge flushing in such a period that the meniscus is unstable, it is possible to prevent meniscus break and unintended discharges.

Fifth Modified Embodiment

A fifth modified embodiment may be a modification of the second to fourth modified embodiments. In the liquid discharge apparatus 10 according to the fifth modified embodiment, the period of the circulation pump 26*c* being in the OFF-state includes a fifth period P5 from a time T5 before the first time (the start time) T1 to the first time T1, and a sixth period P6 from a time T6 before the time T5 to the time T5. The constant period includes a seventh period P7 from the second time (the end time) T2 to a time T7 between the second time T2 and the third time (the start time) T3, and an eighth period P8 from the time T7 to the third time T3. The controller 30 carries out the determining process such that the frequency of the non-discharge flushing for the fifth period P5 is larger than the frequency of the non-discharge flushing for the sixth period P6, and/or such that the frequency of the non-discharge flushing for the eighth period P8 is larger than the frequency of the non-discharge flushing for the seventh period P7.

For example, in the determining process of the step S3 of FIG. 6, the controller 30 determines a fourth predetermined frequency F4 as the frequency of the non-discharge flushing in the fifth period P5, in the static period, before the first period P1 of the increase period, and causes the storage unit 32 to store the same. The fourth predetermined frequency F4 is higher than the first predetermined frequency F1 in the sixth period P6 before the fifth period P5 and included in the static period. The period P5 may be as long as the first period P1. Further, the fifth period P5 may be set longer if the first period P1 gets longer.

Further, the controller 30 determines the second predetermined frequency F2 as the frequency of the non-discharge flushing in the eighth period P8, in the constant period, before the third period P3 of the decrease period, and causes the storage unit 32 to store the same. Provided that the frequency of the non-discharge flushing in the eighth period P8 is higher than the third predetermined frequency F3 in the seventh period P7 before the eighth period P8 and included in the constant period, then it is not limited to the second predetermined frequency F2. However, the frequency for the eighth period P8 is preferably lower than the first predetermined frequency F1. Further, the length of the eighth period P8 may be equal to the length of the third period P3. Further, the eighth period P8 may be set longer if the third period P3 gets longer.

In this manner, based on the determined frequency, the controller 30 generates the control data for the driver elements 23, and carries out the non-discharge flushing process. By virtue of this, in the fifth period P5 before the first period P1 when the non-discharge flushing is not carried out, the non-discharge flushing is carried out at the fourth predetermined frequency F4 higher than the first predetermined frequency F1. Further, in the eighth period P8 before the third period P3 when the non-discharge flushing is not carried out, the non-discharge flushing is carried out at the second predetermined frequency F2 higher than the third predetermined frequency F3. By virtue of this, it is possible to reduce the discharging defection due to the liquid drying during the period when the iron-discharge flushing is not carried out.

Sixth Modified Embodiment

A sixth modified embodiment may be a modification of the above embodiment and the first to fifth modified embodiments. The controller 30 in the liquid discharge apparatus 10 according to the sixth modified embodiment stops the non-discharge flushing after switching the circulation pump 26*c* to OFF.

For example, in the switching process of the step S6 in the example of FIG. 6, the controller 30 switches the circulation pump 26*c* from ON to OFF at the third time T3 depicted in FIGS. 5C, 7C and 8C. After that, the controller 30 stops the driver elements 23 from driving for the non-discharge flushing, and the printing process based on the print data is ended (step S8: Yes).

Seventh Modified Embodiment

A seventh modified embodiment may be a modification of the above embodiment and the first to sixth modified embodiments. In the liquid discharge apparatus 10 according to the seventh modified embodiment, the liquid is other than a UV ink. The UV ink is cured by ultraviolet rays (UV), so that it is more difficult to get dried than other inks. On the other hand, liquids other than the UV ink are easier to get dried than the UV ink. Therefore, by way of determining the frequency of the non-discharge flushing according to the circulation flow amount of the liquid, even for a liquid easy to get dried, it is still possible to reduce the discharging defection due to the liquid drying.

Eighth Modified Embodiment

An eighth modified embodiment may be a modification of the above embodiment and the first to seventh modified embodiments. The liquid discharge apparatus 10 according to the eight modified embodiment is provided with a carriage 16*a* to move with the head 20 mounted on the carriage 16*a*. The controller 30 carries out a moving process to move the carriage 16*a*. In the moving process, the controller 30 starts to move the carriage 16*a*, after the circulation flow amount of the liquid has increased by switching of the circulation pump 26*c* from OFF to ON and then stays at a constant level.

In particular, in the printing process, the controller 30 carries out a recording operation and a conveying operation alternately. The recording operation includes a moving process to move the carriage 16*a* with the head 20 mounted thereon and a, discharging process to discharge the liquid from the head 20. The controller 30 starts the moving process in the constant period after the end time of the increase period of the circulation flow amount (the second time T2).

In such constant period, the meniscus is more stable than that in the increase period. Therefore, by starting moving the carriage 16*a* in the constant period, it is possible to reduce the influence on the meniscus from a dynamic pressure due to the moving, thereby preventing the meniscus break and unintended discharges.

Ninth Modified Embodiment

A ninth modified embodiment may be a modification of the eighth modified embodiment. In the liquid discharge apparatus 10 according to the ninth modified embodiment, in the moving process, the controller 30 stops moving the carriage 16*a* within the period when the circulation flow amount of the liquid stays constant before the circulation flow amount of the liquid starts to decrease by switching of the circulation pump 26*c* from ON to OFF.

For example, the controller 30 stops moving the carriage 16*a* in the constant period before the start time (the third time T3) of the decrease period depicted in FIG. 5C, FIG. 7C and FIG. 8C. In such constant period, the meniscus is more stable than that in the decrease period. Therefore, by stopping moving the carriage 16*a* in the constant period, it is possible to reduce the influence on the meniscus from the dynamic pressure due to the moving, thereby preventing the meniscus break and unintended discharges.

Note that the above embodiment and all modified embodiments may combine each other as far as one does not exclude another. Further, from the above explanation, those skilled in the art shall know well and clearly that many improvements and/or other embodiments are applicable to the present disclosure. Therefore, the above explanation should be understood as merely exemplification and is provided for teaching the best mode for carrying out the present disclosure to those skilled in the art. It is possible to practically change the details of the structure and/or the function of the present disclosure without departing from the spirit and scope of the present invention.

The liquid discharge apparatus, the control method therefor and the medium according to the above embodiments are effective and usable in such a manner as capable of facilitating reducing the power consumption while lessening the discharging defection due to the liquid drying.

What is claimed is:

1. A liquid discharge apparatus comprising:

a head including a nozzle configured to discharge a liquid, and a driver element configured to apply a pressure to the liquid;

a tank configured to store the liquid;

a circulation channel configured to circulate the liquid between the head and the tank;

a pump; and a controller, wherein the controller is configured to carry out:

a non-discharge flushing process of performing a non-discharge flushing by driving the driver element such that the liquid is not discharged from the nozzle;

a switching process of switching the pump between ON and OFF; and a determining process of determining a frequency of driving the driver element in the non-discharge flushing process according to a circulation flow amount of the liquid changing due to the switching of the pump between ON and OFF in the switching process.

2. The liquid discharge apparatus according to claim 1, wherein in the determining process, the controller is configured to determine the frequency of driving the driver element in the non-discharge flushing process such that the frequency of driving the driver element in the non-discharge flushing process for a period of the pump being OFF is same as or larger than the frequency of driving the driver element in the non-discharge flushing process for a period of the pump being ON.

3. The liquid discharge apparatus according to claim 1, wherein the circulation flow amount of the liquid increases in an increase period due to the switching of the pump from OFF to ON, stays constant in a constant period following the increase period, and decreases in a decrease period following the constant period due to the switching of the pump from ON to OFF; and in the determining process, the controller is configured to determine the frequency of driving the driver element in the non-discharge flushing process such that the frequency of driving the driver element in the non-discharge flushing process for the increase period and the frequency of driving the driver element in the non-discharge flushing process for the decrease period are larger than the frequency of driving the driver element in the non-discharge flushing process fir the constant period.

4. The liquid discharge apparatus according to claim 3, wherein the controller is configured to carry out the non-discharge flushing process such that the non-discharge flushing at the frequency of driving the driver element in the non-discharge flushing process for the increase period determined in the determining process is performed during a period, in the increase period, closer to a time point when an increase of the circulation flow amount of the liquid ends than to a time point when the increase of the circulation flow amount of the liquid begins, and/or such that the non-discharge flushing at the frequency of driving the driver element in the non-discharge flushing process for the decrease period determined in the determining process is performed during a period, in the decrease period, closer to a time point when a decrease of the circulation flow amount of the liquid ends than to a time point when the decrease of the circulation flow amount of the liquid begins.

5. The liquid discharge apparatus according to claim 3, wherein the controller is configured to carry out the non-discharge flushing process such that the non-discharge flushing at the frequency of driving the driver element in the non-discharge flushing process for the increase period determined in the determining process is started at a time Ta when an increase rate of the circulation flow amount of the liquid satisfies $(X2-X1)/(T2-T1)$ provided that T1 is a start time of the increase period, T2 is an end time of the increase period, X1 is the circulation flow amount of the liquid at the start time T1, and X2 is the circulation flow amount of the liquid at the end time T2, or is started in a period between the time Ta and the end time T2; and/or such that the non-discharge flushing at the frequency of driving the driver element in the non-discharge flushing process for the decrease period determined in the determining process is started at a time Tb when a decrease rate of the circulation flow amount of the liquid satisfies $(X3-X4)/(T4-T3)$ provided that T3 is a start time of the decrease period, T4 is an end time of the decrease period, X3 is the circulation flow amount of the liquid at the start time T3, and X4 is the circulation flow amount of the liquid at the end time T4, or is started in a period between the time Tb and the end time T1.

6. The liquid discharge apparatus according to claim 5, wherein the increase period includes a first period from the start time T1 to the time Ta, and a second period from the time Ta to the end time T2, the decrease period includes a third period from the start time T3 to the time Tb, and a fourth period from the time Tb to the end time T4; and the controller is configured to carry out the non-discharge flushing process such that the non-discharge flushing is performed in the second period without being performed in the first period, and/or such that the non-discharge flushing is performed in the fourth period without being performed in the third period.

7. The liquid discharge apparatus according to claim 6, wherein a period of the pump being OFF includes a fifth period from a time T5 before the start time T1 to the start time T1, and a sixth period from a time T6 before the time T5 to the time T5, the constant period includes a seventh period from the end time T2 to a time T7 between the end time T2 and the start time T3, and an eighth period from the time T7 to the start time T3; and the controller is configured to carry out the determining process such that the frequency of driving the driver element in the non-discharge flushing process for the fifth period is larger than the frequency of driving the driver element in the non-discharge flushing process for the sixth period, and/or the frequency of driving the driver element in the non-discharge flushing process for the eighth period is larger than the frequency of driving the driver element in the non-discharge flushing process for the seventh period.

8. The liquid discharge apparatus according to claim 1, wherein the controller is configured to stop the non-discharge flushing after switching the pump to OFF.

9. The liquid discharge apparatus according to claim 1, wherein the liquid is a liquid other than an ultraviolet ink.

10. The liquid discharge apparatus according to claim 1, further comprising a carriage configured to move in a state that the head is mounted on the carriage, wherein the controller is configured to carry out a moving process of moving the carriage and, in the moving process, the controller is configured to start to move the carriage after the circulation flow amount of the liquid has increased by switching of the pump from OFF to ON and then stays constant.

11. The liquid discharge apparatus according to claim 10, wherein in the moving process, the controller is configured to stop moving the carriage within the period of the circulation flow amount of the liquid being constant before the circulation flow amount of the liquid starts to decrease by switching of the pump from ON to OFF.

12. A control method for a liquid discharge apparatus, wherein the liquid discharge apparatus comprises:

a head including a nozzle configured to discharge a liquid, and a driver element configured to apply a pressure to the liquid;

a tank configured to store the liquid;

a circulation channel configured to circulate the liquid between the head and the tank; and a pump, the method comprising:

performing a non-discharge flushing by driving the driver element such that the liquid is not discharged from the nozzle;

switching the pump between ON and OFF; and determining a frequency of driving the driver element in the non-discharge flushing process according to a circulation flow amount of the liquid changing due to the switching of the pump between ON and OFF.

13. A non-transitory computer readable medium storing a program that is executable by a controller of a liquid discharge apparatus, wherein the liquid discharge apparatus comprises:

a head including a nozzle configured to discharge a liquid, and a driver element configured to apply a pressure to the liquid;

a tank configured to store the liquid;

a circulation channel configured to circulate the liquid between the head and the tank;

a pump; and the controller, wherein the program causes the controller to carry out:

a non-discharge flushing process of performing a non-discharge flushing by driving the driver element such that the liquid is not discharged from the nozzle;

a switching process of switching the pump between ON and OFF; and a determining process of determining a frequency of driving the driver element in the non-discharge flushing process according to a circulation flow amount of the liquid changing due to the switching of the pump between ON and OFF in the switching process.

* * * * *